US006332232B1

(12) United States Patent
Neal

(10) Patent No.: US 6,332,232 B1
(45) Date of Patent: Dec. 25, 2001

(54) PORTABLE EASY LIFTING DEVICE

(76) Inventor: Paul F. Neal, 1918 Country Club Dr., Lynn Haven, FL (US) 32444

( * ) Notice: Subject to any disclaimer, the term of this patent is extended or adjusted under 35 U.S.C. 154(b) by 0 days.

(21) Appl. No.: 09/366,310

(22) Filed: Aug. 2, 1999

Related U.S. Application Data

(63) Continuation-in-part of application No. 09/192,342, filed on Nov. 16, 1998, now abandoned.

(51) Int. Cl.[7] ..... A47C 31/00
(52) U.S. Cl. ..... 5/662; 5/84.1; 297/411.23
(58) Field of Search ..... 5/81.1 R, 84.1, 5/662; 297/411.23, 411.24, DIG. 10; 135/66, 67, 75; 4/576.1, 577.1

(56) References Cited

U.S. PATENT DOCUMENTS 2,773,542 * 12/1956 Chasin ..... 297/DIG. 10
3,739,793 * 6/1973 Wilson ..... 135/67 X
4,869,279 * 9/1989 Hedges ..... 135/67
5,226,439 * 7/1993 O'Keeffe et al. ..... 135/66
5,397,169 * 3/1995 Willans ..... 297/411.23
5,509,432 * 4/1996 Peterson ..... 135/65
5,983,421 * 11/1999 Walser ..... 5/81.1 R
6,134,731 * 10/2000 Thom et al. ..... 5/662
6,138,301 * 10/2000 Battiston ..... 5/81.1 R

* cited by examiner

*Primary Examiner*—Michael F. Trettel
*Assistant Examiner*—James M Hewitt

(57) ABSTRACT

The combination of an article of furniture, having a lateral support or frame member, and a portable easy lifting device, especially for seniors and those physically challenged, adjustably secured to the lateral support or frame member. The lifting device includes a laterally adjustable base for resting on the floor, and a pair of adjustable handle grips telescopically engaging the base, where the device mounts a pair of vertically movable brackets for adjustably securing the device to the lateral support or frame member.

7 Claims, 5 Drawing Sheets

PORTABLE EASY LIFTING DEVICE

RELATED APPLICATION

This application is a continuation-in-part of U.S. Ser. No. 09/192,342, filed Nov. 16, 1998, now abandoned by the inventor hereof, and entitled, "Portable Easy Lift Device", where the contents of the parent application are incorporated herein by reference in their entirety.

FIELD OF THE INVENTION

This invention relates to the field of lifting devices, such as for the elderly or physically challenged, where assistance is often needed to aid oneself in getting up from a sofa, for example, while being supported to the standing position.

BACKGROUND OF THE INVENTION

The present invention is directed to a portable easy lifting, personal device that can be particularly useful for the elderly or physically challenged individual. The prior art, as exemplified by several commercial products, offer expensive alternatives to the user, where one device, for instance, tilts the seat forward allowing the user to shift his/her weight and thereby better position one's legs to facilitate standing. However, such a device is expensive as it is part of a formal chair, and is not readily transferable to another chair, nor can it be transported and used with a variety of chairs or sofas, or other articles of furniture. Sofas or overstuffed chairs can be particularly challenging. While the cushioned seat is considerably more comfortable to the user, it has the drawback in that the user's weight is shifted rearward making it more difficult to quickly or conveniently exit the seat.

The prior art, as reflected in the following U.S. patents, offer specific aids to selected users:

a.) U.S. Pat. No. 5,502,851, to Costello, relates to a lifting, standing and walking device employing base side members whose rear track width is adjustable to facilitate use of the device to lift severely disabled, elderly or other physically challenged persons from a wheelchair, and then allow the overall device width to be reduced for passage through narrow doorways or other passageways. The device also employs a lifting mechanism which can be adjusted by means of a hydraulic jack over a wide range of positions to facilitate lifting of individuals from a prone position on the floor to a standing position. The lifting mechanism includes a pair of individually adjustable generally L-shaped lifting yoke arms that can be adjusted both vertically and angularly to accommodate individuals with posture conditions and provide selective weight bearing alleviation. A special full body harness is employed with the device which has long thigh wraps and a wide lumbar belt for widely distributing lifting pressure and reducing the risk of injury.

b.) U.S. Pat. No. 5,178,025, to Bennett et al., teaches a seating device for aged, infirm and handicapped persons and includes a passive, pivotably mounted, energy storage device laterally disposed below a seat base, and a parallelogram linkage between the seat base and a chair seat for controlling elevation and tilting motion of the seat. A lever which can be coupled at selectable points along an arc about the pivot point of the energy storage device exerts torque on the parallelogram linkage to oppose downward movement and aid upward movement. By varying the position of engagement of the energy storage device to the lever, the force exerted can be adjusted to the weight of the user.

Neither of the patented devices, nor known commercial devices offer the versatility and portability of the lifting device of the present invention. The manner by which the instant invention meets and satisfies the requirements of the elderly or physically challenged will become more apparent in the description which follows, particularly when read in conjuction with the accompanying drawings.

SUMMARY OF THE INVENTION

The present invention is directed to the combination of an article of furniture, such as a sofa, stuffed chair, or bed, having a lateral support spaced from a supporting surface, i.e. floor, by a plurality of leg members, and an improved personal lifting device to facilitate assisting oneself off of the article of furniture. The lifting device comprises a pair of essentially tubular members, where each support member has a turned first end at about 90 degrees, and a turned second end at an angle of at least 90 degrees, where the ends lie in planes perpendicular to one another. The support members are slidably joined by an adjustable extension member engaging the respective second ends. Further, there are a pair of essentially tubular members slidably engaging and adjustable to the first ends. Finally, each first leg mounts a slidably adjustable support stay adapted to engage the lateral support to provide stability to the device.

Accordingly, an object of this invention is to provide a low-cost, light-weight, portable device to assist a user, particularly useful for senior citizens, in lifting oneself from an article of furniture.

Another object of the invention is the provision of the use of adjustable, telescopic and pivotal members that allow the user to easily and quickly transform the device to a compact and transportable assembly.

A further object hereof is the ability to selectively transform the device into a safety feature attachable to a conventional bed to prevent falling from the bed.

These and other objects will become apparent to those skilled in the art from the following detailed description and drawings.

DETAILED DESCRIPTION OF PREFERRED EMBODIMENT

Figure 1:
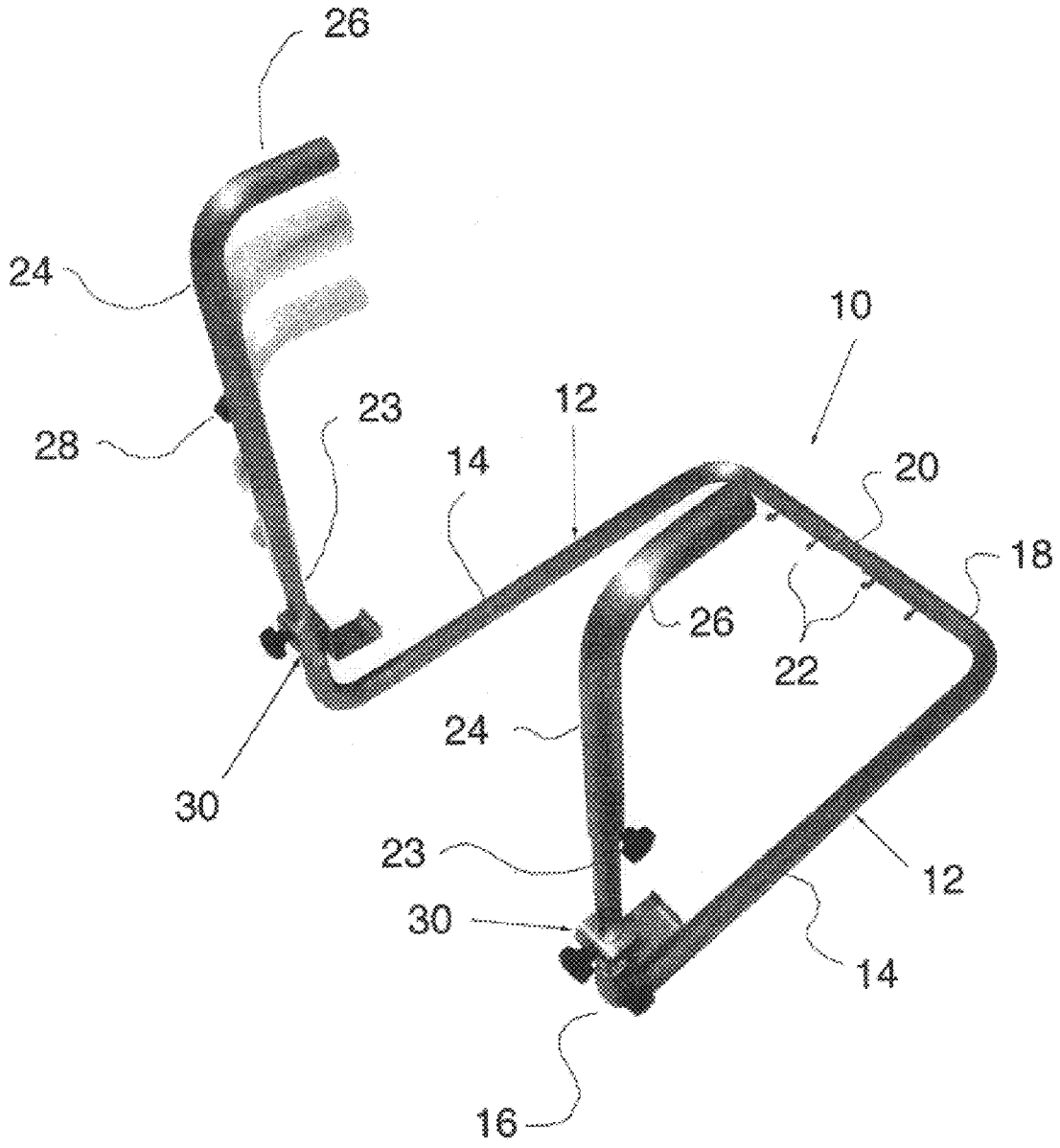
FIG. 1 is a perspective view, illustrating the portable easy lifting assembly according to this invention.

This invention is directed to a mobile, light-weight, and hence readily transportable, lifting device for people needing assistance in getting up from or easing into a seated position, particularly one seated in an overstuffed chair, sofa, or on a bed, for example. The device is illustrated in the several Figures, where like reference numerals represent like features or components throughout the several views.

Figure 2:
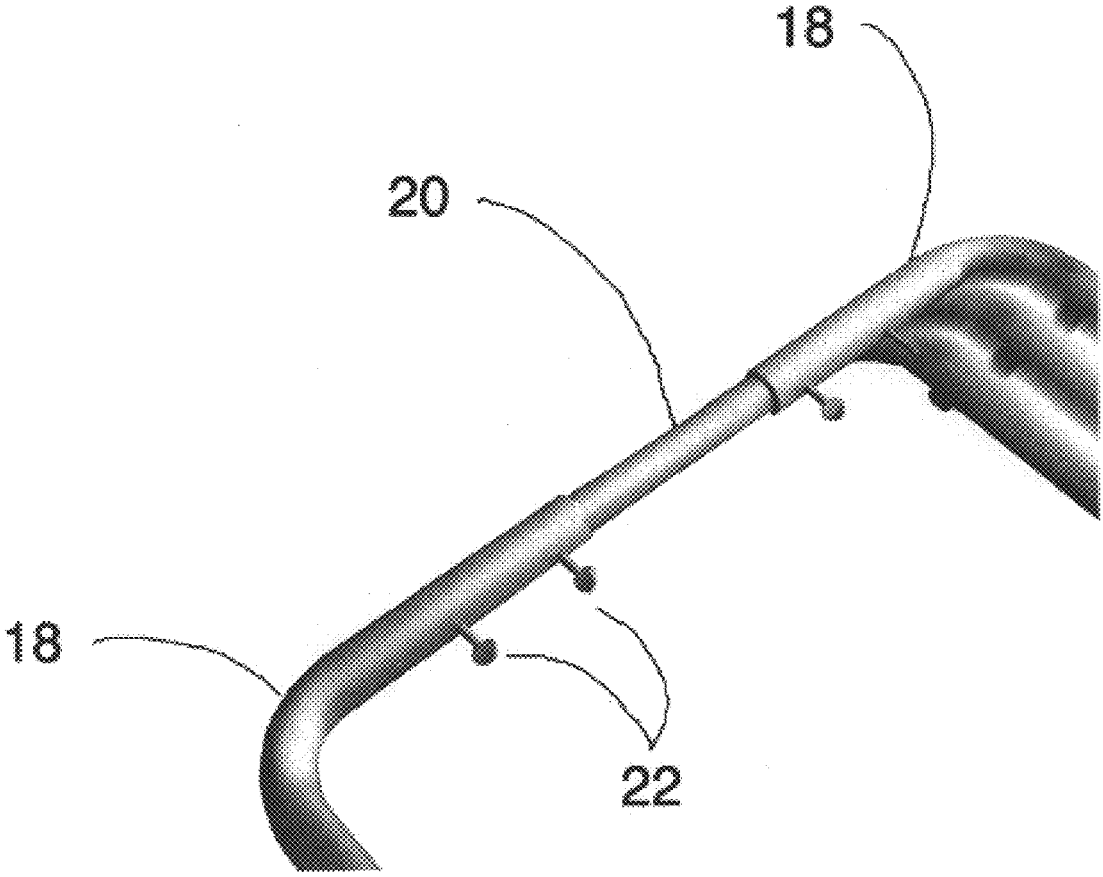
FIG. 2 is a partial perspective view illustrating the lateral adjustable mechanism for the assembly hereof.
Figure 3:
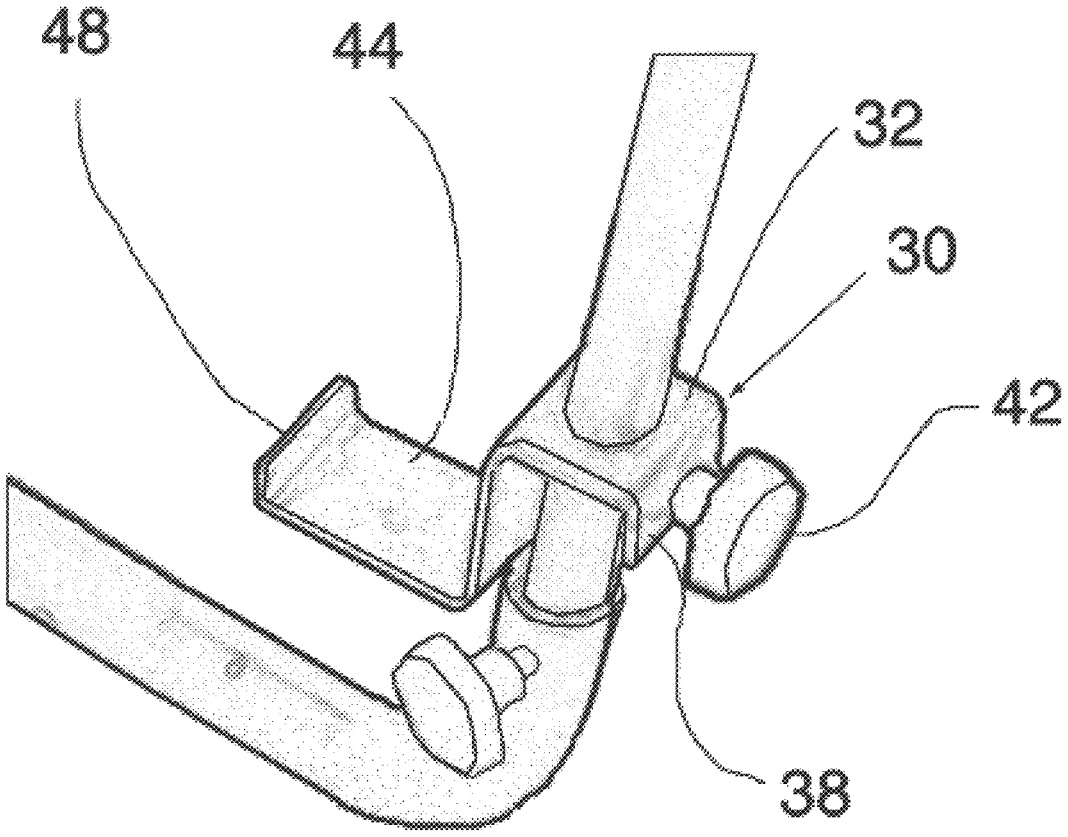
FIG. 3 is a partial perspective view showing the furniture securing bracket for the easy lifting assembly of this invention.

Turning now to FIGS. 1 to 3, the portable, easy lifting assembly 10 of this invention comprises a pair of floor support members 12, preferably fabricated of tubular metal, having a base bar 14, a first end 16 bend upwardly about 90 degrees, and a second end 18 bent at least 90 degrees, where said second end 18 is perpendicular to said first end 16. Slidably engaging the respective second ends 18 is an extension bar 20, where plural thumb screws 22 may be provided to adjustably fix the lateral dimension of the assembly to accommodate the user thereof, see FIG. 2.

Slidably engaging each respective first end 16 via extension member 23, is an L-shaped handle member 24, where the remove end 26 functions as a hand grip to help the user to lift oneself from a seated position. To fix the relative height of the remote end 26, or hand grip, a threaded adjustment pressure know 28 is provided.

Figure 4:
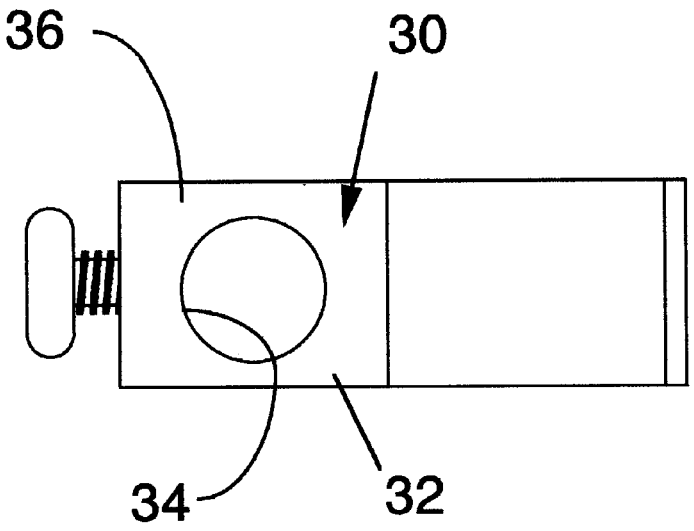
FIG. 4 is an enlarged top view of the furniture securing bracket shown in FIG. 3.
Figure 5:
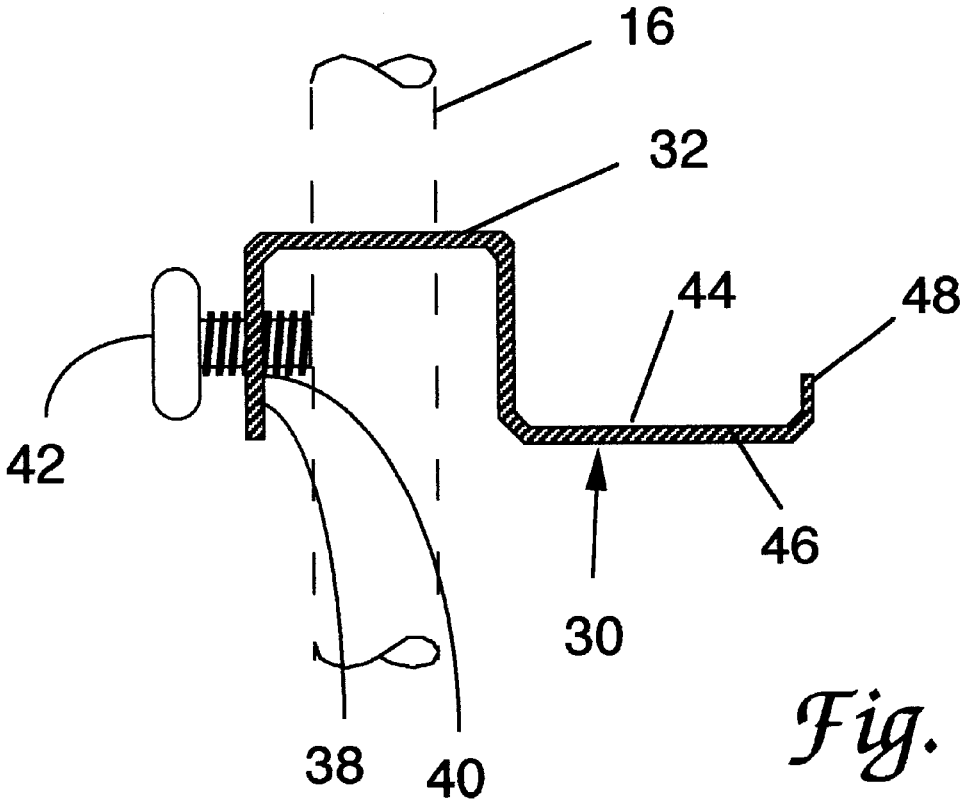
FIG. 5 is a front view of the bracket of FIG. 4.

Since stability of the assembly 10 relative to an article of furniture, such as an overstuffed chair, sofa, or bed, is essential to the effective use of the assembly 10 for seniors, for example, the slidably adjustable bracket 30, as illustrated in FIGS. 3 to 5, is provided. The bracket 30 comprises an inverted U-shaped end or first segment 32 having an opening 34 in the base 36 for sliding movement along first end 16, or extension member 23. The free leg 38 of the U-shaped end or first segment 32 includes a threaded aperture 40 for mounting an adjustment knob 42 for pressure engagement with the first end 16, or extension member 23, at a selected position.

Figure 6:
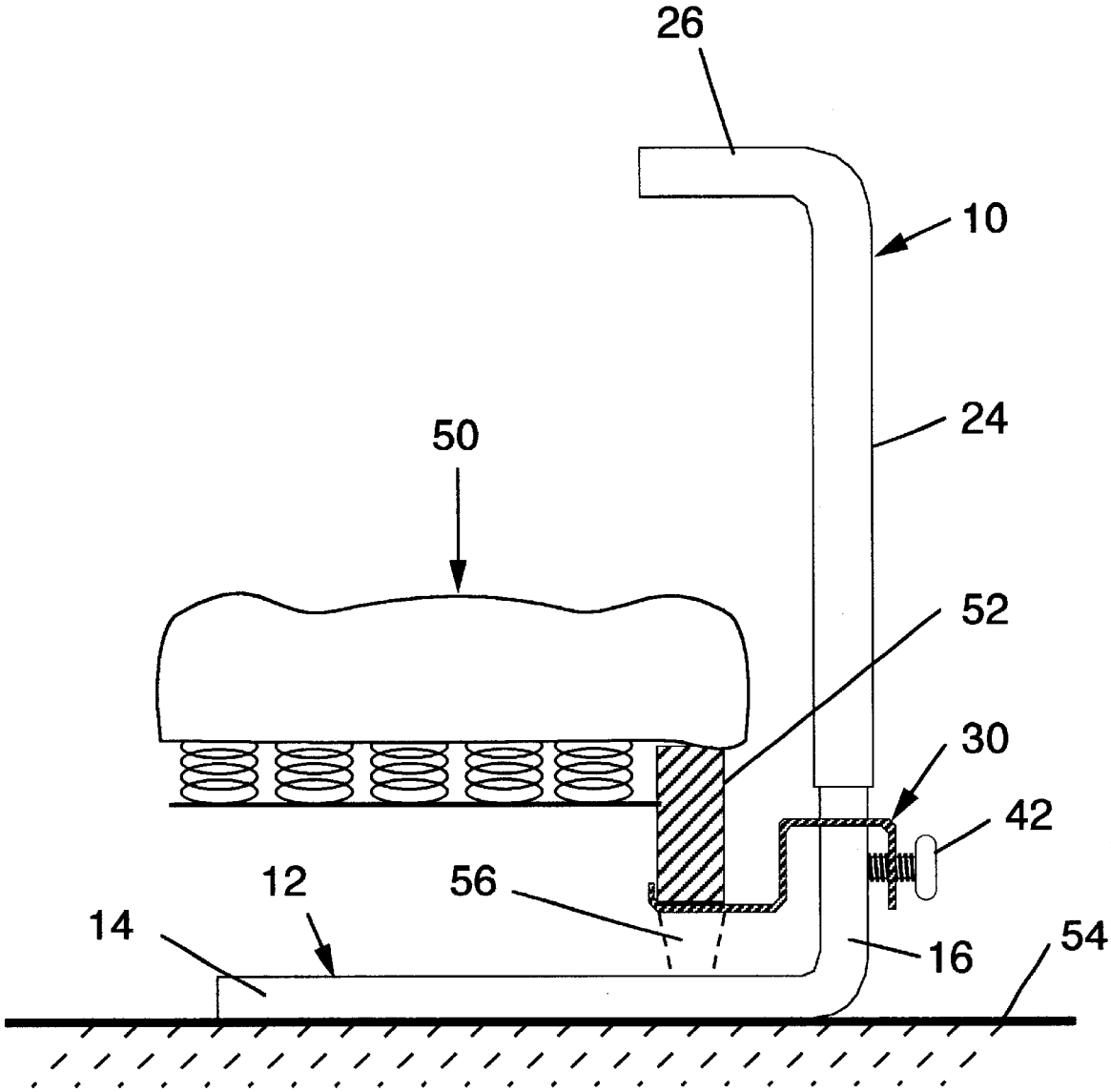
FIG. 6 is a side view of the assembly showing an operable position for the assembly relative to an article of furniture.

The opposite leg or second segment 44 includes a lateral extension 46, preferably with an upturned end 48, for engagement with an article of furniture, and an intermediate wall 45. FIG. 6 illustrates in simplified form a typical article of furniture 50 to which the assembly 10 hereof is attached. The article of furniture 50, as known in the art, includes a lateral support or frame 52, spaced from a supporting surface 54, i.e. floor, where said frame 52 includes a front face 53 and a lower face 55, and further includes plural legs 56. In operation, the assembly 10 is assembled in the manner illustrated in FIG. 1, with the respective base bars 14 and extension bar 20 laterally adjusted and fixed to comfortably accomodate the user. In this position, the assembly is slid along the floor under the article of furniture 50, where the respective handle members 24 are in close proximity to the lateral support, or frame 52. With the assembly 10 so positioned, each bracket 30 is raised into engaging contact with the lateral support, or frame 52, more precisely with wall 45 in contact with front face 53 and leg 44 in contact with lower face 55 (FIG. 6), and the adjustment knob 42 tightened against the first end 16. With the assembly 10 so positioned, it is ready for use in assisting the user to rise or even ease onto the article of furniture.

It is contemplated that additions, modifications and changes may be made to the lifting assembly of this invention. Accordingly, no limitation is intended to be imposed on the invention except as set forth in the appended claims.

What is claimed is:

1. In combination with an article of furniture having a lateral support member spaced from a supporting surface by a plurality of leg members, where said lateral support member includes front and lower faces, an improved personal lifting device to facilitate assisting oneself off of said article of furniture, said lifting device comprising:

a.) a pair of essentially tubular support members, each comprising a first portion each said support member having a turned first end at an angle of about 90 degrees, relative to said first portion and a turned second end at an angle of at least 90 degrees, relative to said first portion wherein said first turned ends lie in a plane perpendicular to said second turned ends;

b.) an adjustable extension member slidably engaging said second ends;

c.) a pair of essentially tubular handle members slidably engaging and adjustable with said first ends; and d.) each said first end having mounted these to a slidably adjustable support bracket adapted to engage said lateral support member at said front and lower faces, in order to spatially fix said lifting device to said article of furniture.

2. The combination according to claim 1, wherein each said tubular handle member includes a free end angularly turned to function as a hand grip.

3. The combination according the claim 1, including means to fix the spatial relationship of said tubular support members via said adjustable extension member.

4. The combination according to claim 1 wherein each said slidably adjustable support bracket comprises a first segment for sliding engagement with its respective said turned first end, and a second segment extending laterally for engaging said lateral support at said front and lower faces.

5. The combination according to claim 4, wherein said first segment includes an adjustment knob for selectively positioning and fixing the relationship between said adjustable support bracket and its respective said turned first end.

6. The combination according to claim 5, wherein each said tubular handle member is slidably secured to a respective said first end by a second extension member.

7. The combination according to claim 6, wherein each said tubular handle member includes an adjustment knob for selectively positioning and fixing the relationship between each said tubular handle member and its respective said second extension member.

* * * * *